US006702093B2

(12) United States Patent
Lyons et al.

(10) Patent No.: US 6,702,093 B2
(45) Date of Patent: Mar. 9, 2004

(54) GAMING DEVICE STAND

(75) Inventors: David Lyons, Egg Harbor, NJ (US); Frederick Triboletti, Hammonton, NJ (US); William Vaino, Jr., Pleasantville, NJ (US)

(73) Assignee: Park Place Entertainment Corp., Las Vegas, NV (US)

( * ) Notice: Subject to any disclaimer, the term of this patent is extended or adjusted under 35 U.S.C. 154(b) by 0 days.

(21) Appl. No.: 10/008,521

(22) Filed: Nov. 9, 2001

(65) Prior Publication Data

US 2003/0089577 A1 May 15, 2003

(51) Int. Cl.[7] ..... G07F 1/04
(52) U.S. Cl. ..... 194/344; 194/350
(58) Field of Search ..... 194/344, 350, 194/351; 453/63; 248/127, 146, 346.01; 109/45, 49, 53, 55, 58, 58.5, 66, 67; 193/DIG. 1; 232/44, 55; 312/274, 283, 330.1, 223.1

(56) References Cited

U.S. PATENT DOCUMENTS 1,696,522 A * 12/1928 Clegg et al. ..... 109/46
3,941,138 A * 3/1976 Woodhouse ..... 453/16
5,113,990 A * 5/1992 Gabrius et al. ..... 194/206
5,211,275 A * 5/1993 Halsey et al. ..... 194/350
5,554,070 A * 9/1996 Takatoshi et al. ..... 453/31
5,618,042 A * 4/1997 Takemoto et al. ..... 273/143 R
5,678,679 A * 10/1997 Berman ..... 194/344
5,715,927 A * 2/1998 Brandt ..... 194/344
5,813,914 A * 9/1998 McKay et al. ..... 463/46
5,826,882 A * 10/1998 Ward ..... 273/309
5,890,440 A * 4/1999 Spur ..... 109/47
6,116,597 A * 9/2000 Rowe et al. ..... 273/143 R
2002/0060124 A1 * 5/2002 Thompson ..... 194/350

FOREIGN PATENT DOCUMENTS

JP 2-22794 A * 1/1990 ..... G07F/1/02

* cited by examiner

*Primary Examiner*—Donald P. Walsh
*Assistant Examiner*—Mark J. Beauchaine
(74) *Attorney, Agent, or Firm*—Weide & Miller, Ltd.

(57) ABSTRACT

A stand is provided for supporting at least one gaming device having a bottom through which coins may be released. The stand has an interior area divided into at least two compartments, one compartment comprising a drawer area and the other comprising a coin compartment. A drawer is moveably positioned in the drawer area. An opening is provided through the top for allowing coins released from the gaming machine to be directed into the coin compartment. In one embodiment, the stand is configured to accept two pairs of gaming machines facing in opposing directions and includes a pair of drawers at each end and a centrally located coin compartment and electrical area. In other embodiments, the stand is configured to support two gaming machines and includes a drawer at each end, or is configured to support a single gaming machine and includes a single drawer and coin compartment located side-by-side.

23 Claims, 5 Drawing Sheets

GAMING DEVICE STAND

FIELD OF THE INVENTION

The present invention relates to a stand for a gaming device, and more particularly to such a stand for use with a gaming device having a drop or release feature for retained coins, the stand having improved access and security features.

BACKGROUND OF THE INVENTION

In order to participate in a game presented by a gaming device, a player must place a wager or bet. Commonly, the wager or bet is evidenced by one or more coins. The coins are inserted into a coin accepting device of the gaming device. Accepted coins are routed to a coin hopper.

If a player is a winner of a game, the player may be paid winnings in the form of coins. In this instance, coins may be routed from the coin hopper of the gaming device to a coin tray. The player may retrieve paid coins from the tray.

Those coins which are not paid remain in the coin hopper. After a period of time, the coin hopper may become full. The game operator must travel to the gaming device, open the gaming device, and remove these retained coins. This process is time consuming and takes the gaming device out of play for a period of time.

Unfortunately, the size of a gaming device is generally limited. Therefore, the size of the slot coin hopper which may be located in the gaming device is limited and thus the number of coins which may be stored is limited. As one means of addressing this problem, gaming devices often have a coin diverter or drop feature which prevents coins from being directed to the slot coin hopper and instead causes coins to be directed to a chute which directs the coins to the bottom of the gaming device.

In one arrangement, the gaming device is located on a support having a hole formed in its top surface. The chute in the gaming device aligns with the hole formed in the support. Coins are dropped through the chute into a coin bucket associated with the support. In this arrangement, the coin bucket serves as an overflow to the coin hopper of the gaming device. Of course, the coin bucket must be kept secure within the support so that the coins are not lost or stolen. The game operator may on a less frequent basis travel to the gaming machine and empty the coin hopper and/or coin bucket.

Current supports have very limited functionality and suffer from difficulty of accessing and using internal areas thereof. An improved gaming device stand or support is desired.

SUMMARY OF THE INVENTION

The present invention is a stand for supporting one or more gaming machines or devices. In one embodiment, the stand is arranged to support at least one gaming machine of the type which dispenses or releases coins from a bottom portion thereof.

In one embodiment the stand has opposing first and second ends. Opposing first and second sides extend between the ends, the ends and sides generally defining a periphery of the stand. In one embodiment, the first and second ends comprise walls.

The stand also includes a base and a top. The base, top, ends and sides generally define an interior area. The top is adapted to support the one or more gaming machines.

The interior area is divided into one or more areas or compartments. In one embodiment, these areas include at least one drawer area and at least a coin compartment.

In one embodiment, the stand is particularly adapted to support four gaming machines. In this embodiment, the interior area includes four drawer areas. A pair of drawer areas are located at the first end and a pair of drawer areas are located at the second end of the stand. The coin compartment is located between the pairs of drawer areas. In one embodiment, one drawer area of each pair of drawer areas faces the first side, and the other of the drawer areas faces the second side of the stand.

A drawer is associated with each drawer area. Each drawer is mounted for movement between a closed position in which the drawer is located in the drawer area and an open position in which the drawer is at least partially extended from the stand.

In another embodiment the stand is particularly adapted to support a pair of gaming machines. In this embodiment, a single drawer area is located at each end of the stand. The coin compartment is located between the drawer areas. The coin compartment and drawer areas are all accessible from one of the sides of the stand.

In yet another embodiment, the stand is particularly adapted to support a single gaming machine. In this embodiment, a single drawer area and coin compartment are located side by side and are accessible from one of the sides of the stand.

In one embodiment, one or more openings are provided in the top through which coins may be directed from a gaming machine to the coin compartment. In the embodiment where the stand is arranged to support four gaming machines, four such openings are provided.

Means may be provided for guiding the coins through the opening to the coin compartment. In one embodiment, this means comprises a funnel, and in one or more embodiments, a tube extending from a bottom end of the funnel.

In one embodiment, access to the coin compartment is provided from one of the sides of the stand through a door. The door is movably connected to the stand, such as by a hinge.

In one embodiment, the stand includes an electrical compartment. The electrical compartment is divided from the drawer areas and coin compartment by a wall. Access is provided to the electrical compartment via a door.

One or more electrical openings are provided through the top. Electrical and communication wiring may be directed from a gaming machine supported by the stand through the top into the electrical compartment.

In one embodiment, the base of the stand is supported above ground level by legs extending along the sides of the stand and the ends of the stand. A hollow space is created under the base. Wiring and the like may be located in this space. In addition, the forks of a forklift may be passed under the base and into this hollow space for lifting and transporting the stand.

Further objects, features, and advantages of the present invention over the prior art will become apparent from the detailed description of the drawings which follows, when considered with the attached figures.

DETAILED DESCRIPTION OF THE INVENTION

The invention is a stand for a gaming device. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention is a stand for one or more gaming devices or machines. The stand is particularly adapted to support gaming devices or machines of the type which drop or release coins from a coin hopper for secondary storage or retention. The stand includes an interior area which is divided into a plurality of compartments. One or more of the compartments house a drawer. Another compartment is a coin compartment in which coins dropped from the gaming devices are stored.

Figure 1:
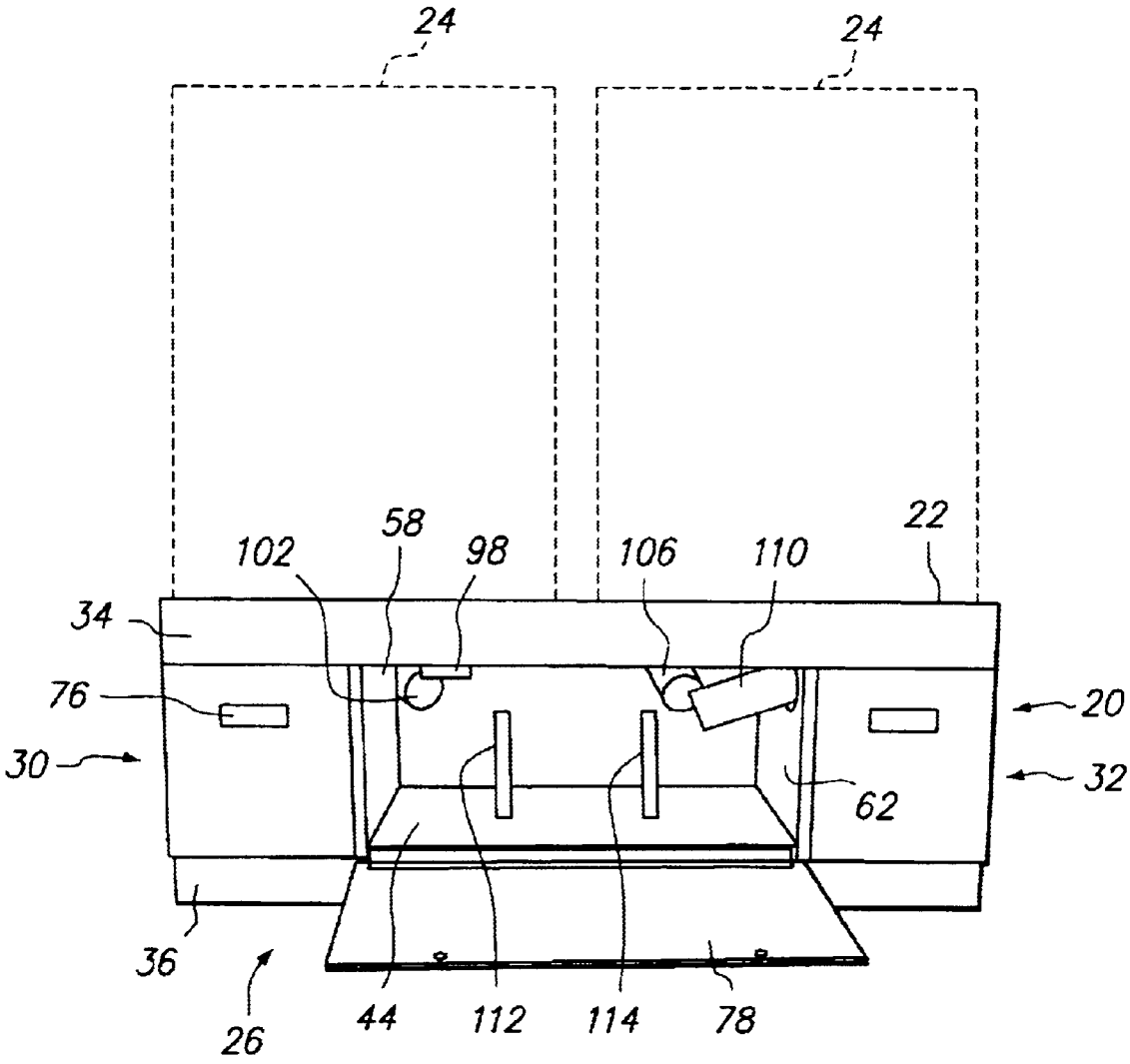
FIG. 1 is a front view of a gaming device stand in accordance with one embodiment of the invention.
Figure 2:
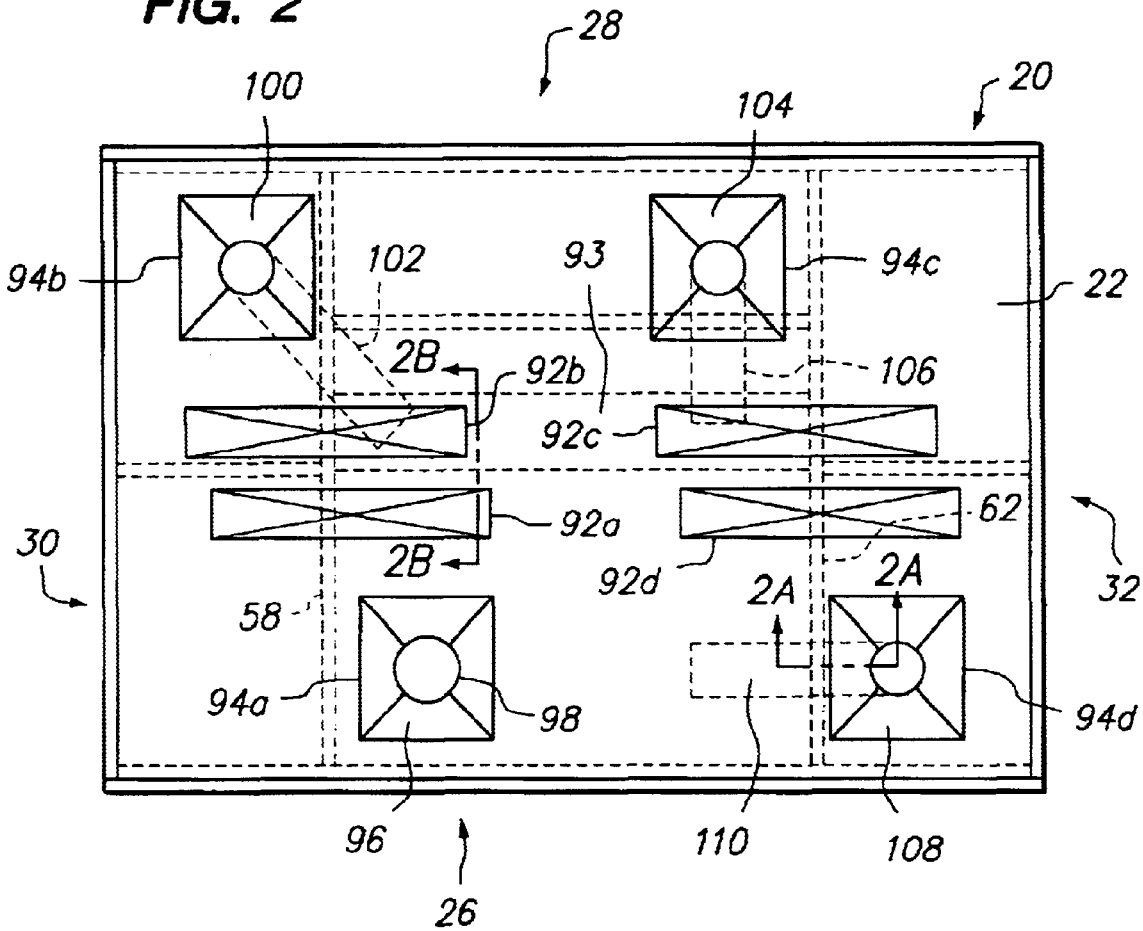
FIG. 2 is a top view of the gaming device stand illustrated in FIG. 1.
Figure 3:
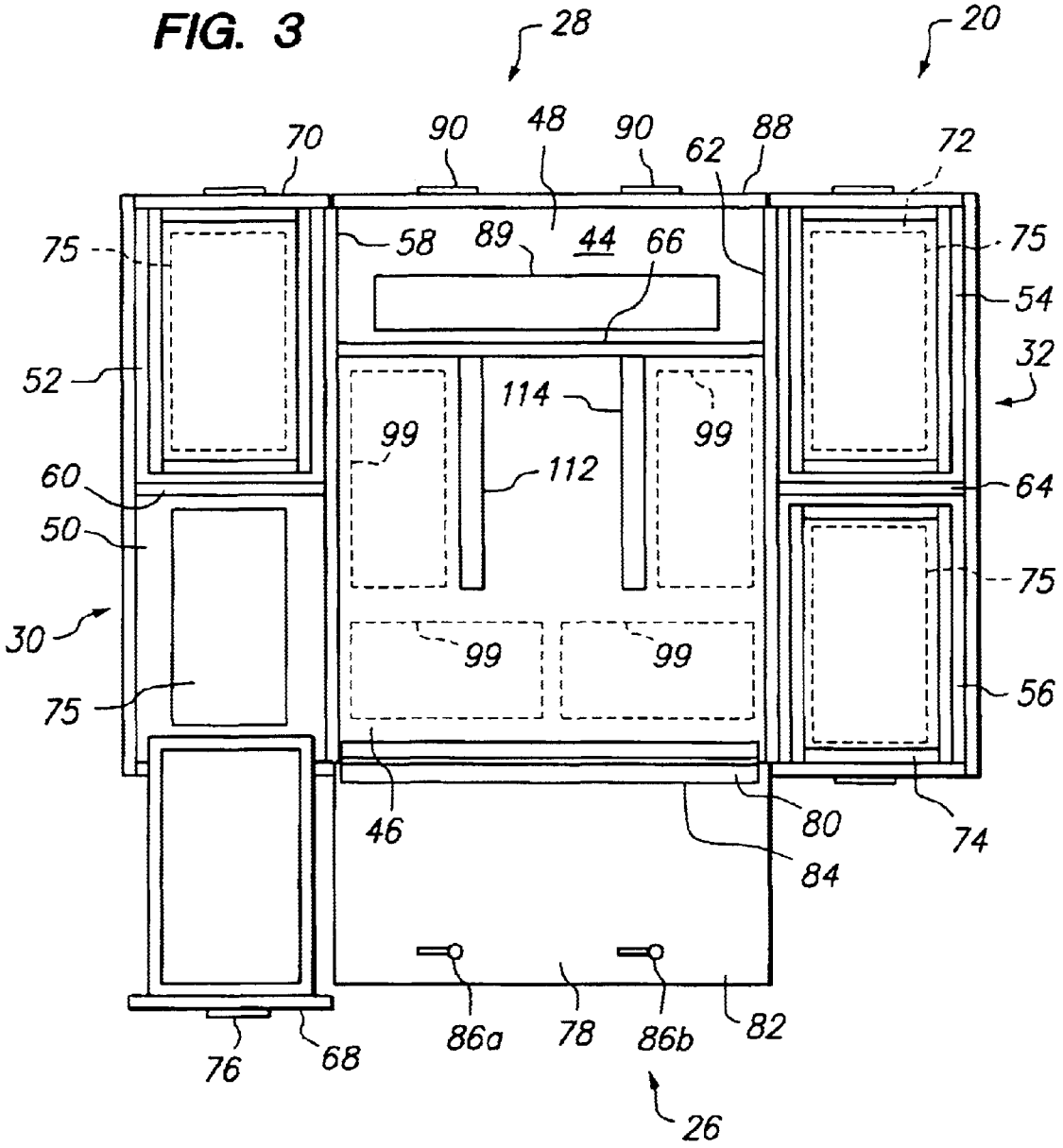
FIG. 3 is a top view of the gaming device stand illustrated in FIG. 2 with a top surface thereof removed.

One embodiment of a stand 20 in accordance with the present invention is illustrated in FIGS. 1–3. Referring to FIG. 1, the stand 20 has a top surface 22 upon which a plurality of gaming devices or machines 24 may be supported. These gaming devices 24 may have a variety of configurations and be arranged to present a wide variety of different games. For example, the gaming devices 24 may be slot or video type gaming devices. Preferably, one or more of the gaming devices 24 may include a coin drop or release feature for dispensing coins from a bottom or lower portion thereof.

The embodiment stand 20 illustrated in FIGS. 1–3 is particularly suited to supporting four (4) gaming devices or machines 24. Referring to FIG. 1, two gaming devices 24 are located in a side-by-side relationship, these two gaming devices facing outwardly. Another two gaming devices 24 are located behind the two gaming devices illustrated, the other two gaming devices facing in the opposite direction (i.e. the two pairs of gaming machines face away from one another).

Referring to FIG. 2, the stand 20 has a first side 26 and an opposing second side 28. The stand 20 also has opposing first and second ends 30,32 extending between the first and second sides 26,28. The first and second sides 26,28 and first and second ends 30,32 generally define a perimeter of the stand 20. In one embodiment, the first and second sides 26,28 are longer than the first and second ends 30,32, such that the stand 20 has a generally rectangular perimeter shape.

In one embodiment, the stand 20 is about 56 inches long from end to end, and about 36 inches deep from side to side. Of course, the stand 20 may have a variety of dimensions, especially when considering the size of the gaming machines to be placed thereon.

In one embodiment, the first and second ends 30,32 generally comprise vertically extending walls. Each wall spans the distance between the first and second sides 26,28. The walls may be constructed of one or more members, such as wood or metal panels.

In one embodiment, the first side 26 and second side 28 are defined in part by a supporting structure, and as described in more detail, one or more moveable members. In this regard, the term "side" does not refer to a singular element, but generally a region or area of the stand. Referring to FIG. 1, in one embodiment the first side 26 includes a facia 34 and a leg 36. Between the facia 34 and the leg 36 are a number of elements, such as drawers and doors, as described in more detail below. Preferably, the second side 28 is similarly arranged, as seen in FIG. 3.

In a preferred embodiment, the stand 20 includes a generally enclosed interior area. The first and second sides 26,28 and first and second ends 30,32 generally define the outer perimeter of this area. In addition, the top 22 generally defines the upper extent of the area, and a bottom or base 44 defines a bottom or lower extent of the area. The interior area is said to be generally enclosed in that, as described in more detail below, at one or more times portions of one or both of the sides may be open, allowing access to the interior area.

Referring to FIG. 2, the top 22 preferably extends horizontally, and is thus generally perpendicular to the first and second sides 26,28 and first and second ends 30,32. In a preferred embodiment, the top 22 has a plurality of openings therein. The nature of these openings, including their characteristics, are described in more detail below. The top 22 has an upper surface which generally defines the top or uppermost extent of the stand 20.

Referring to FIG. 1, the bottom or base 44 is, in one embodiment, set upwardly from the lowest extent of the first and second sides 26,28 and first and second ends 30,32. In one embodiment, the bottom or base 44 is supported at its first and second ends by the walls defining the first and second ends 30,32 of the stand 20. At the front side 26 of the stand 20, the bottom or base 40 is supported by the leg 36 which extends from end to end 30,32. In the embodiment illustrated, the leg 36 is inset from the remainder of the front side 26 of the stand 20. In one embodiment, the bottom or base 44 is also supported by another leg (not shown) which is similarly located at the second side 28 of the stand 20.

In this arrangement, a hollow space is defined under the base 44. This hollow space is bounded by the legs, ends of the stand 20, the base 44, and generally a support surface such as a floor upon which the stand 20 is placed. As described in more detail below, such an arrangement is useful in moving the stand 20.

Preferably, the interior area is divided into a plurality of areas or compartments. As best illustrated in FIG. 3, in one embodiment, the interior area is divided into a coin compartment 46, an electrical area or compartment 48, a first drawer area 50, a second drawer area 52, a third drawer area 54 and a fourth drawer area 56.

In a preferred embodiment, the drawer areas 50,52,54,56 are located at the ends of the stand 20. There are two (i.e. a pair of) drawer areas at the first end 30 of the stand 20 and two (i.e. a pair of) drawer areas at the second end 32 of the stand 20. In the arrangement illustrated, the first and second drawer areas 50,52 are defined in part by the wall forming the first end 30 of the stand 20, and a first inner wall 58. The wall forming the first end 30 of the stand 20 and the first inner wall 58 form opposing sides of the first and second drawer areas 50,52.

An end of both the first and second drawer areas 50,52 are defined by a common rear wall 60. The rear wall 60 divides the first and second drawer areas 50,52 from one another. The rear wall 60 extends between the wall comprising the first end 30 of the stand 20 and the first inner wall 58.

Preferably, each drawer area is accessible from one of the sides of the stand 20. In one embodiment, an end of the first drawer area 50 opposite the rear wall 60 is open at the first side 26 of the stand 20. An end of the second drawer area 52 opposite the rear wall 60 is open at the second side 28 of the stand 20.

Likewise, the third and fourth drawer areas 54,56 are defined in part by the wall forming the second end 32 of the stand 20, and a second inner wall 62. The wall forming the second end 32 of the stand 20 and the second inner wall 62 form opposing sides of the third and fourth drawer areas 54,56. An end of both the third and fourth drawer areas 54,56 are defined by a common rear wall 64. The rear wall 64 divides the third and fourth drawer areas 54,56 from one another. The rear wall 64 extends between the wall comprising the second end 32 of the stand 20 and the second inner wall 62.

Once again, each drawer area is accessible from one of the sides of the stand 20. In one embodiment, an end of the third drawer area 54 opposite the rear wall 64 is open at the second side 28 of the stand 20. An end of the fourth drawer area 56 opposite the rear wall 64 is open at the second side 28 of the stand 20.

The coin compartment 46 and electrical compartment 48 are located between the sets or pairs of drawer areas. In particular, the coin compartment 46 and electrical compartment 48 are located between the first inner wall 58 and second inner wall 62. An end of both of the compartments 46,48 is defined by a dividing wall 66. The dividing wall 66 extends between the first inner wall 58 and the second inner wall 62.

Access to the coin compartment 46 and electrical compartment 48 is likewise preferably provided from one of the sides of the stand 20. In one embodiment, access is provided to the coin compartment 46 to the first side 26 of the stand 20, and access is provided to the electrical compartment or area 48 from the opposing second side 28 of the stand 20.

The sizes of the various compartments or areas may vary, especially depending upon the size of the stand 20. In one embodiment each drawer area or compartment is about 12–16 inches wide, 18–20 inches deep and 14 inches high. The coin compartment 46 is about 28–30 inches wide and 28–30 inches deep. The electrical compartment 48 is also about 28–30 inches wide but is only about 7–8 inches deep. In this arrangement, the coin compartment 46 is larger than the electrical compartment 48, for reasons which will become apparent below.

A first drawer 68 is preferably associated with the first drawer area 50. The first drawer 68 may be of a variety of types well known to those of skill in the art. The first drawer 68 preferably has a pair of sides and ends defined by walls extending upwardly from a bottom. Thus, the first drawer 68 has an interior area which is enclosed on the sides and bottom and which is accessible from the top. In one embodiment, the front of the first drawer 68 may include a front face or cover which is large enough to extend over surrounding portions of the front side 26 of the stand 20. In this manner, the covers provide a more aesthetically pleasing arrangement for the stand 20.

In one embodiment, a handle 76 is mounted to the front face of the first drawer 68 for use by a user in opening and closing the drawer. The first drawer 68 is movable between a first open or extended position, and a second closed position. The first drawer 68 is illustrated in its closed position in FIG. 1 and in its extended or open position in FIG. 3. In its open position, a user of the stand 20 may access the interior of the drawer and place things in or remove things from the drawer. In its closed position, the interior area of the first drawer 68 is generally inaccessible.

As is well known, the first drawer 68 may be mounted to the stand 20 by a set of rollers or slides. Alternatively, guides or other members may be used to aid in guided movement of the first drawer 68 into and out of the first drawer area 50. Such guides may also limit the extent of travel of the drawer to inhibit the drawer from being removed or falling out of the stand 20.

In one embodiment, a lock (not shown) is provided for selectively locking the first drawer 68 in its closed position. The lock may be of a variety of types, such as a sliding bolt or rotating latch lock. The lock may be operable only with the use of a key.

Preferably, a second drawer 70 is associated with the second drawer area 52 in like manner to the first drawer 68. A third drawer 72 is associated with the third drawer area 54 and a fourth drawer 74 is associated with the fourth drawer area 56, also in like manner.

In one embodiment, an opening 75 is provided in the base 44 at the location of each of the drawer areas 50,52,54,56. The openings 75 are thus located under the drawers 68,70, 72,74 when the drawers are extended into the stand 20 in their closed position. These openings 75 provide access to the hollow area beneath the stand 20, and also reduce the weight of the stand 20 by reducing the amount of material forming the base 44.

In one embodiment, means are provided for selectively controlling access to the coin compartment 46 at the first side 26. In one embodiment, the means comprises a door 78. The door 78 is connected to the stand 20 via one or more hinges 80. In one embodiment, the door 78 has a top edge 82 and a bottom edge 84. The bottom edge 84 is connected to the hinge 80, which is in turn connected to the stand 20. In this arrangement, the door 78 may be rotated upwardly into a closed position where access to the coin compartment 46 is prevented. The door 78 may also be rotated downwardly into the position illustrated in FIG. 3 where access to the coin compartment 46 is permitted.

One or more handles (not shown) may be connected to a front face or surface of the door 78 for use in opening and closing the door. In addition, one or more locks 86*a,b* or similar elements may be used to maintain the door 78 in a closed position.

In similar fashion, means are provided for selectively controlling access to the electrical compartment 48 at the second side 28. In one embodiment, the means comprises a door 88. The door 88 is connected to the stand 20 via one or more hinges (not shown). In one embodiment, the door 88 has a top edge and a bottom edge, and the bottom edge is connected to the hinge, the hinge in turn connected to the stand 20. In this arrangement, the door 88 may be rotated upwardly into a closed position where access to the electrical compartment 48 is prevented, as illustrated in FIG. 3. The door 88 may also be rotated downwardly into a position in which access to the electrical compartment 48 is permitted.

In the embodiment illustrated, a pair of handles 90 are connected to a front face or surface of the door 88 for use in opening and closing the door. In addition, one or more locks (not shown) or similar elements may be used to maintain the door 88 in a closed position.

In the embodiment illustrated, an opening 89 is provided in the base 44 within the electrical compartment 48. As illustrated, the opening 89 is a generally rectangular opening. The opening 89 leads to the hollow space below the base 44.

As indicated above, the top 22 has a plurality of openings therein. In general, these openings provide access from the exterior of the stand 20 through the top 22 to the interior area of the stand 20.

Referring to FIG. 2, four electrical openings 92*a–d* are provided through the top 22, one electrical opening being provided for each of the four gaming devices or machines which are to be supported by the stand 20. The location and size of the electrical openings 92*a–d* may vary depending on the size and placement of the gaming devices 24. In one embodiment, the electrical access to the gaming device 24 is at a bottom rear area. When the gaming devices 24 are paired side-by-side and when the pairs of devices are located back-to-back, the electrical openings 92*a–d* may be configured as illustrated in FIG. 2.

In a preferred embodiment, each electrical opening 92*a–d* is provided through the top 22. In one embodiment, each electrical opening 92*a–d* is about 17 inches long and about 3 inches wide. As indicated, the size of the openings 92*a–d* may vary.

Figure 2A:
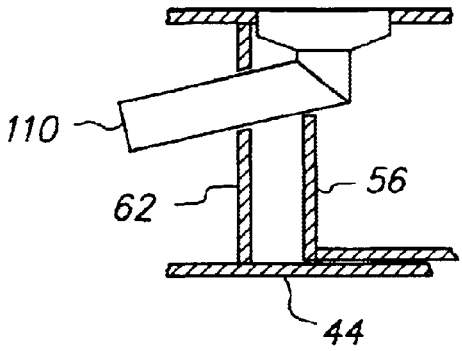
FIG. 2A is a partial cross-sectional view of the gaming device stand illustrated in FIG. 1 taken along line 2A—2A therein.
Figure 2B:
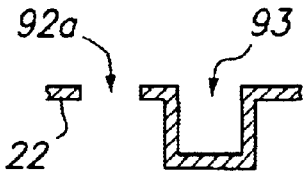
FIG. 2B is a partial cross-sectional view of the gaming device stand illustrated in FIG. 1 taken along line 2B—2B therein.

Referring to both FIGS. 2 and 2B, in one embodiment, a trough 93 is provided in the top 22. In one embodiment, the trough 93 is formed in the top 22 and extends between two of the electrical openings. The trough 93 is adapted to accept electrical, communication and/or other wiring, cabling or elements.

Referring to FIG. 2, four coin drop openings 94*a–d* are also provided through the top 22. One coin drop opening 94 is provided for each of the four gaming devices or machines which are to be supported by the stand 20. The exact location and size of the coin drop openings 94*a–d* may vary depending upon the size and placement of the gaming devices 24. When the gaming devices 24 are arranged on the stand 20 as described above and have their coin drop openings located at a right front bottom area (when facing the machine), then the drop openings 94*a–d* are preferably configured as illustrated in FIG. 2.

In one embodiment, each coin drop opening 94*a–d* is formed as a generally square opening in the top 22. The coin drop openings 94*a–d* are located in positions corresponding to respective gaming devices 24. In such a configuration, however, all but one of the openings 94*a–d* are located over a portion of the interior area of the stand 20 other than the coin compartment 46.

In accordance with the invention, it is desired that the coins from each machine 24 be directed through the respective coin drop opening 94*a–d* to the coin compartment 46. In this manner, all of the dropped coins are stored in a central, secure area of the stand 20. To accomplish this, means are provided for directing the coins from the openings 94*a–d* to the coin compartment 46.

In one embodiment, the coin drop openings 94*a–d* are much larger than the drop chute or other coin drop device of the gaming machine 24. In this manner, misalignment of the gaming machine 24 with respect to the drop opening is accommodated with the coins released from the gaming machine still being directed into a respective opening. Preferably, however, means are provided for directing the coins from the larger coin drop opening to a smaller drop area.

The coin drop opening 94*a* is already located over the coin compartment 46, so that only means for funneling or directing the coins into a smaller drop area is necessary. In the embodiment illustrated, this means comprises a funnel 96 and associated drop tube 98. The funnel 96 has a top end and a bottom end. The top end is generally square in perimeter shape, matching the shape of the coin drop opening 94*a*. The funnel 96 narrows from its first end to its second end, which is preferably tubular in construction. Preferably, the drop tube 98, which comprises a generally cylindrical tube, extends downwardly from the bottom end of the funnel 96. Of course, the funnel 96 and drop tube 98 may be integrally or separately constructed. As illustrated in FIG. 1, the drop tube 98 is generally vertically extending.

Preferably, the funnel 96 is securely mounted to the stand 20 so that it stays in position when heavy loads of coins are dropped from the gaming machine 24. In one embodiment, screws or other fasteners are used to securely mount the funnel 96 to the top 22 of the stand 20. In one embodiment, the funnel 96 may be made removable from the top and/or bottom of the top 22 of the stand 20, such as for clearing coin jams.

In one embodiment, the funnel 96 and drop tube 98 are constructed of plastic, such as a heavy gauge PVC. In one embodiment, each coin drop opening 94*a–d*, and thus the funnels at their top ends, are about 8 inches square. At their bottom ends, the funnels form a tubular opening which is about 3 inches in diameter.

The coin drop opening 94*b* is located over the second drawer area 52. As such, means must be provided for directing coins from the opening 94*b* to the coin compartment 46, and for funneling or directing the coins into a smaller drop area. As illustrated in FIG. 2, this means includes a funnel 100 and a drop tube 102. The funnel 100 is similarly configured and arranged to the funnel 96 just described. The drop tube 102 preferably comprises a tube extending from the bottom end of the funnel 100 to the coin compartment 46. In the arrangement illustrated, the drop tube 102 has a first end which is mounted to the bottom end of the funnel 100. The drop tube 102 is sufficiently long that its second end is located in the coin compartment 46. In the embodiment illustrated, the drop tube 102 is oriented at an angle and extends in generally directly from the funnel 100 to the coin compartment 46.

The coin drop opening 94*c* is over the electrical compartment 48. As such, means must be provided for directing coins from the opening 94*c* to the coin compartment 46, and for funneling or directing the coins into a smaller drop area. As illustrated, this means includes a funnel 104 and a drop tube 106. Preferably, the funnel 104 and drop tube 106 are similarly arranged to the funnel 100 and drop tube 102 just described.

Lastly, the coin drop opening 96*d* is located over the fourth drawer area 74. As such, means must be provided for directing coins from the opening 94*d* to the coin compartment 46, and for funneling or directing the coins into a smaller drop area. As illustrated, this means includes a funnel 108 and a drop tube 110. Preferably, the funnel 108 and drop tube 110 are similarly arranged to the funnel 100 and drop tube 102 just described.

In one embodiment, the second or drop end of the tubes 98,102,106,110 are all near the top of the coin compartment 46, as best illustrated in FIG. 1. In this arrangement, a container may be located under the second end or outlet of the tube. In one embodiment, the coin hopper comprises a bin or bucket 99, as is known in the art of coin collection.

The bucket or bin 99 is located under the outlet of each tube 98,102,106,110 for collecting the coins directed through the tube.

It will now be appreciated that the configuration of various portions of the stand 20 is dictated by the coin drop tubes 98, 102,106,110. As illustrated, the drop tube 102 associated with the second coin drop opening 94*b* passes through the second drawer area 52. To avoid interference, the sides and end of the second drawer 70 must not extend upwardly too great a distance. Likewise, the fourth drawer 74 must be similarly configured. In the embodiment illustrated, the dividing wall 66 also includes a passage through which the drop tube 106 extends. This arrangement is illustrated in greater detail in FIG. 2A.

Referring to FIG. 3, the stand 20 is specially configured to accept the one or more buckets, bins or other containers 99 for holding the coins which are directed through the tubes 98,102,106,110. These buckets or bins 99 may have a wide variety of configurations. In one embodiment, each bucket or bin 99 is about 8 inches tall, 6 inches wide and about 10–14 inches long, having a rectangular cross-section.

In one embodiment, means are provided for securing the coin buckets or bins 99 within the coin compartment 46. As illustrated, a first support 112 and a second support 114 extend upwardly from the bottom 44 of the stand 20. The first and second supports 112,114 generally comprise walls or other generally vertically extending members. The first support 112 is spaced from the first inner wall 58 a sufficient distance to permit placement of the coin bucket or bin 99 in the space there between. Preferably, the distance is not so large, however, that the bucket or bin 99 placed therein may move out of position.

Likewise, the second support 114 is spaced from the second inner wall 62 a sufficient distance to permit placement of the coin bucket or bin 99 in the space there between. Once again, the distance is not so large, however, that the bucket or bin 99 placed therein may move out of position.

Additional features and aspects of the stand 20 will become apparent in conjunction with the description of the use of the stand 20 as described below.

Preferably, four gaming devices 24 are mounted upon the top 22 of the stand 20. As described above, two gaming devices 24 are mounted side-by-side facing the first side 26 of the stand 20. Two more gaming devices 24 are mounted side-by-side facing the second side 28 of the stand 20.

Power cords, communication lines such as network cables and similar elements are extended from the electrical compartment 48 through each electrical opening 92*a–d* to the respective gaming device 24. Primary access to these components is provided through the door 88 at the second side 28 of the stand 20. Access is gained by unlocking, if necessary, the door 88 and then rotating the door 88 downwardly into an open position.

Access to the electrical compartment 48 is prevented by returning the door 88 to a closed position and locking it. At this time, the electrical compartment 48 is enclosed by the door 88, the top 22, bottom 44, dividing wall 66, and first and second inner walls 58,62. In this manner, tampering with the power, networking and other support systems for the gaming machines 24 is prevented.

Each gaming machine 24 has a coin drop which is located over its respective coin drop opening 94*a–d*. Coins may be delivered from the gaming machine 24 into any of the four coin drop openings 94*a–d*. When delivered, the coins are caught by the funnel 96,100,104,108 and routed via the respective tube 98,102,106,110 to the particular coin bucket or bin 99 located in the coin compartment 46.

Periodically, gaming personnel may check, and if necessary empty, the coin buckets or bins 99. An authorized person may unlock and open the door 78 to gain access to the coin compartment 46.

If necessary, a technician may access the various electrical and communication connections, such as cables, routers or other equipment which are located in the equipment compartment 48. Again, the technician may unlock and open the door 88 to gain access to the electrical compartment.

Access may also be gained to one or more of the drawers 68,70,72,74. The drawers 68,70,72,74 provide storage, such as for empty coin bins and other materials related to the gaming machines 24.

Advantageously, the stand 20 is arranged into secure areas. For example, while an authorized party, such as a coin handling employee, may gain access to the coin compartment 46, the remaining areas of the stand 20 remain secure and inaccessible from that party. Likewise, a technician may gain access to the electrical compartment 48, but from that compartment is not permitted to access other areas, such as the coin compartment 46. Access is also provided to each drawer 68,70,72,74 independent of the other areas of the stand 20. In this manner, theft of coins, tampering with electronics and the like is minimized.

Figure 4:
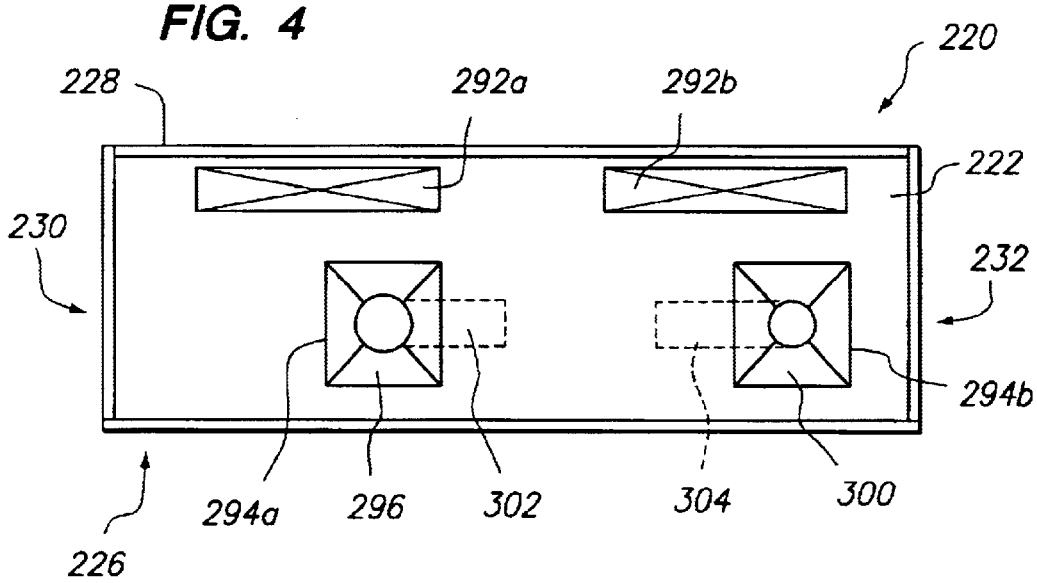
FIG. 4 is a top view of a gaming device stand in accordance with another embodiment of the invention.
Figure 5:
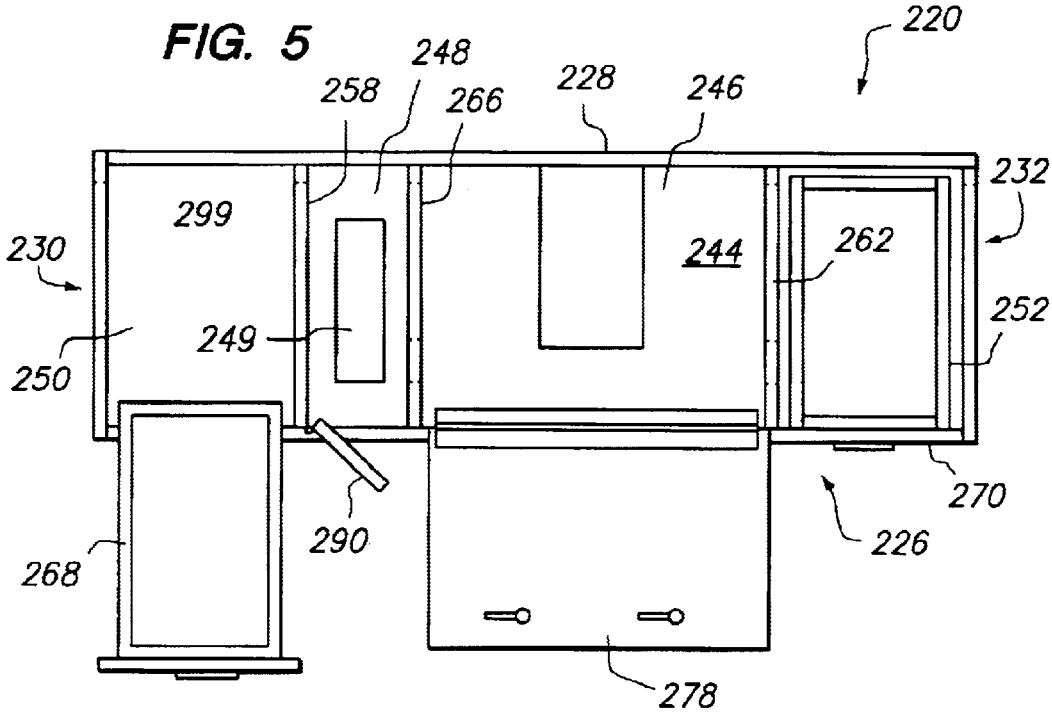
FIG. 5 is a top view of the gaming device stand illustrated in FIG. 4 with a top surface thereof removed.

Another embodiment stand 220 in accordance with the invention is illustrated in FIGS. 4 and 5. Illustrated therein is a particular embodiment stand 220 adapted to support a pair of gaming devices in a side-by-side arrangement.

In general, the stand 220 is similar in many respects to the gaming stand 20 illustrated in FIGS. 1–3 and described above. The stand 220 has a first side 226, a second side 228, a first end 230 and a second end 232. In the embodiment stand 220 illustrated, the second side 228, first end 230 and second end 232 all comprise generally upstanding wall members.

The stand 220 has a generally rectangular periphery. The stand 220 has an interior or internal area. This interior area is defined by the periphery, as well as a top 222 and a bottom 244.

The interior area is divided into a plurality of compartments or areas. As illustrated, the interior area includes a first drawer area 250. The first drawer area 250 is defined in part by the wall comprising the first end 230 and the wall comprising the second side 228. In addition, a first inner or dividing wall 258 is spaced from the wall comprising the first end 230 and comprises a second side of the drawer area 250. As illustrated, this dividing wall 258 extends generally parallel to the wall comprising the first end 230 from the first side 226 to the second side 228.

The second drawer area 252 is similarly configured, with a second inner or dividing wall 262, the wall comprising the second end 232 and the wall comprising the second side 228 generally defining the perimeter of the area. In this configuration, the first and second drawer areas 250,252 are located at opposing ends of the stand 220.

Access is provided to the first and second drawer areas 250,252 from one of the sides of the stand 220. In the embodiment illustrated, access is provided from the first side 226 of the stand 220.

In one embodiment, the interior area includes a coin compartment 246 and an electrical compartment 248. The coin and electrical compartments 246,248 are located between the first and second drawer areas 250,252. Preferably, the two compartments 246,248 are divided or separated by a third inner or dividing wall 266. The electrical compartment 248 is thus generally defined by the first and third inner or dividing walls 258,266 and the wall comprising the second side 228 of the stand 220. The coin compartment 246 is generally defined by the second and third inner or dividing walls 262,266 and the wall comprising the second side 228 of the stand 220. As illustrated, the coin compartment 246 is preferably dimensionally wider or larger than the electrical compartment 248.

Access is provided to the coin compartment 246 and electrical compartment 248 from one of the sides of the stand 220. Preferably, access is provided from the same side at which access is provided to the drawer areas, namely the first side 226 of the stand 220.

Preferably, a first drawer 268 is located in the first drawer area 250. The first drawer 268 may be configured in a similar manner to the drawers described above and include a handle and, in one or more embodiments, a locking mechanism. A second drawer 270 is located in the second drawer area 252. The second drawer 270 may be similarly configured as well.

Means are provided for selectively providing access to the coin compartment 246. In one embodiment, this means comprises a door 278. The door 278 is preferably arranged in a similar manner to the door 78 of the first embodiment stand 20 described above. As illustrated, the door 278 is associated with the first side 226 of the stand 220.

Means are also provided for selectively providing access to the electrical compartment 248. In one embodiment, this means comprises a door 290. In this embodiment, the door 290 is preferably hingedly connected to the stand 220 along an vertical edge thereof, so that the door 290 rotates about a vertical instead of horizontal axis.

In the embodiment illustrated, the door 290 providing access to the electrical compartment 248 is located at the front side 226 of the stand 220 as well (opposite the embodiment stand 20 illustrated and described above). This arrangement is advantageous in that the stand 220 may be located with its second side 228 against a wall or the like, and access to all interior areas of the stand 220 may be gained from the first side 226 of the stand 220.

In like fashion to the stand 20 described above, a plurality of openings or access points are provided through the top 222 of the stand 220 into the interior area thereof. First, a pair of electrical openings 292*a*,292*b* are provided for the two gaming devices which the stand 220 is intended to support. Again, the size, shape and placement of the openings 292*a*,292*b* through the top 222 is substantially a function of the design or arrangement of the gaming device which the stand 220 is intended to support. As illustrated, the openings 292*a*,292*b* are located near the second side 228 of the stand 220 and spaced apart from one another.

In one embodiment, passages 299 or cutout areas are provided at the top of the first and second ends 230,232, and the interior walls 258,262,266 near the second side 228. These passages 299 are useful in routing wiring, such as electrical cords and networking cabling through the various portions of the stand 220.

In addition, a pair of coin drop openings 294*a*,294*b* are provided. The size, shape and placement of the openings 294*a*,294*b* is again substantially a function of the design or arrangement of the gaming devices which the stand 220 is intended to support. As illustrated, in order to facilitate alignment with the coin drop areas of the gaming devices, the openings 294*a,b* may be located over other than the coin drop area 246 of the stand 220.

In this arrangement, means must be provided for funneling dropped coins into a smaller area and directing them to the coin drop area 246. A funnel 296 is associated with the first coin drop opening 294*a*. Preferably, the funnel 296 is configured similar to the funnels described above in conjunction with the first embodiment stand 20. In addition, a drop tube 302 extends from a bottom end of the funnel 296 to the coin compartment 246. In the arrangement illustrated, this requires that the drop tube 302 pass through the third dividing wall 266.

Likewise, a funnel 300 is associated with the second coin drop opening 294*b*. A drop tube 304 extends from a bottom portion of this funnel 300 to the coin compartment 246.

In one embodiment, the base or bottom 244 of this embodiment stand 220 is also set upwardly from the lowermost portion of the ends 230,232 and sides 226,228 of the stand. In this manner, a hollow space is again defined under the stand 220.

Use of this embodiment stand 220 is similar to the stand 20 described above, except that only two gaming machines are placed on the stand 220.

Figure 6:
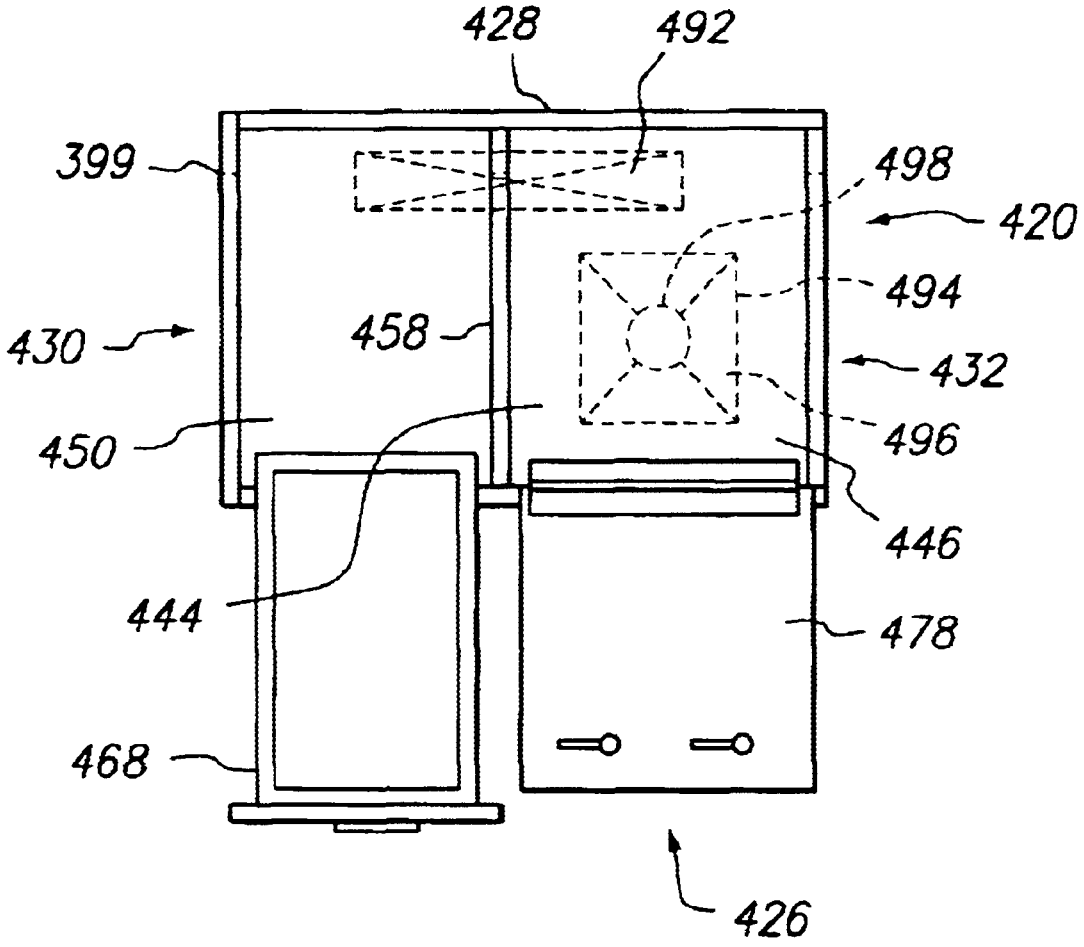
FIG. 6 is a top view of a gaming device stand in accordance with yet another embodiment of the invention, the stand illustrated with a top surface thereof removed.

Another embodiment stand 420 in accordance with the invention is illustrated in FIG. 6. Illustrated therein is a particular embodiment stand 420 adapted to support a single gaming device.

In general, the stand 420 has a first side 426, second side 428, first end 430 and second end 432. In one embodiment, an upstanding wall generally defines each of the second side 428, first end 430 and second end 432. The stand 420 also includes a top (not shown) and a bottom 444.

The stand 420 includes an interior space. Once again, the interior space is preferably divided into areas or compartments. In the embodiment illustrated, the interior space includes a drawer area 450 and a coin compartment 446. The drawer area 450 is divided or separated from the coin compartment 446 by an interior or dividing wall 458.

A drawer 468 is associated with the drawer area 450. As illustrated, the drawer 468 is accessible from the first side 426 of the stand 420.

A door 478 is provided for selectively providing access to the coin compartment 446. In the embodiment illustrated, the door 478 is connected to the stand 420 via at least one hinge located along a lower edge of the door 478.

As illustrated in phantom, in a preferred embodiment, a coin drop opening 494 is provided in a top (not shown) of the stand 420. The coin drop opening 494 is again square in one embodiment, and as illustrated is located over the coin compartment 446.

Means are provided for guiding dropped coins from the gaming machine into the coin compartment 446. In the embodiment illustrated, this means comprises a funnel 496 which is mounted in the coin drop opening 494. In one embodiment, a tube 498 extends downwardly from the bottom end of the funnel 496 for directing the coins into a bin or bucket (not shown).

In addition, an electrical opening 492 is provided. As illustrated, this opening 492 is provided near the second or rear side 428 of the stand 420. The opening 492 is preferably rectangular in shape.

In one embodiment, passages 399 or cut-outs are provided at the top of the first and second ends 430,432 near the second side 428. Again, electrical wiring, network cabling or the like may be extended through these passages 399.

The gaming device stands of the invention may be configured in a variety of manners. In one or more embodiments, the size and shape of the stands, and the size, shape and placement of the various compartments or areas may vary.

The stands of the invention may be constructed of a wide variety of materials, such as wood or metal. In one embodiment, laminate material may be used to cover exterior and/or interior surfaces of the stand for aesthetic reasons.

The size, shape, and location of the various openings in the top of each stand may vary. For example, the coin drop openings may be circular or oval instead of square. In such event, the size and shape of the corresponding funnel may be similarly arranged.

In a preferred embodiment, the interior or dividing walls inside the stand extend between the bottom and top of the stand. In this manner, access between the various areas defined in part by those dividing walls is prohibited. In other embodiments, the walls may only be partial walls, providing mainly structural integrity and support to the stand and elements thereof.

Various features of the stand of the invention may be varied. For example, the handle associated with each drawer or door may be a separate element mounted to or in the drawer or door, or be formed therein, such as in the form of a cut-out.

The size and shape of the funnels and drop tubes may vary. For example, the drop tubes may have a larger or smaller diameter. The drop tubes preferably extend at a rather obtuse angle so that coins are aided by gravity in being directed from the gaming machine to the coin compartment. The exact angle of extension may vary, however.

In one or more embodiments, the sizes and shapes of the compartments or internal areas to the stand may vary. Further, the number of compartments and their locations may vary. For example, a larger number of drawer areas may be provided. In one embodiment, drawer areas may be vertically arranged, or single drawer areas filled with vertically arranged drawers.

The stand in accordance with the invention may be configured to support other numbers of gaming machines than specifically described above. For example, a stand may be configured to support three gaming machines, or five or more gaming machines.

As used herein, the term coin may have many meanings. The term coin may mean government issued currency, such as U.S. $0.25 "quarters." The term also includes tokens and other objects.

As another aspect of the invention, there is provided an arrangement permitting easy transport of a gaming stand, such as a stand as described above. As described above, with respect to the embodiment illustrated in FIGS. 1–3, in a preferred embodiment that stand 20 is provided with a base or bottom 44 which is supported by legs and/or ends of the stand 20. In this manner, a hollow space is provided below the base or bottom 44 of the stand 20. Likewise, the other embodiment stands are, in one or more embodiments, similarly arranged. The hollow space is useful in accepting a lifting device, such as the forks of a forklift, hydraulic lift or the like.

In one embodiment, one or more cut-outs or openings are provided in one or both ends of the stand 20. The cut-outs are sized to permit the passage of the forks of a forklift or other lifting device into the hollow area defined under the base 44 of the stand 20. In this manner, a forklift or similar lifting device may be used to support the stand 20 from beneath the base 44, and raise and transport the stand 20. This is useful for moving the stand from one location to another, such as when changing the layout of a casino floor. In an embodiment of the stand such as the stand 220 or stand 420 which is arranged to be located against a wall, the second or other side which is arranged to face a wall, other stands or the like may be provided with an open area along that side below the area of the base for accepting the lifting device.

The base of the stand may be reinforced or otherwise particular suited to being lifted from below by a lifting device. For example, a metal plate may be provided at the bottom surface of the base of the stand for this purpose.

The gaming device stand in accordance with the present invention has a number of benefits. In general, a stand is provided which provides for enhanced access to interior areas thereof, improved use of space, and a high level of security for retained coins and gaming machine power, communication and other wiring/connections.

A particular advantage of the invention is realized as a result of the slot stand of the invention including at least one drawer. As one aspect of operation of a gaming machine, the gaming machine dispenses coins. Coins may be dispensed as winnings or when a player "cashes-out." Frequently, the rate at which coins are dispensed is greater than at which they are received. This is especially true when the machine is arranged to accept funds for playing a game in forms other than coins, such as paper currency, tickets or credit cards.

In this event, the operator of the gaming machine, such as a casino employee, must obtain coins and place them in the hopper of the gaming machine for later dispensing. This would commonly entail the employee traveling from the gaming machine to a slot booth to obtain coins, and then traveling back to the gaming machine. If the gaming machine was out of coins, the gaming machine would be unusable during this time.

As one aspect of the invention, hopper fill bags containing coins may be securely stored in the stand. As indicated, the stand has a variety of secure compartments in which such hopper fill bags may be stored. Because these compartments are secure, coins may be stored at the location of the gaming machine instead of remotely at the slot booth.

More particularly, storage of the hopper fill bags in the drawer or drawers of the slot stand of the invention, in which case a great number of additional advantages are realized. First, by storing the hopper fill bags in the drawers, access to the fill bags is greatly increased. While the hopper fill bags may be located in the coin compartment, access thereto is difficult. When full of coins, the hopper fill bags are heavy. When placed in the coin compartment, a casino employee must squat down to gain entry to the compartment, and at the same time attempt to move the heavy fill bag out of the compartment. When placed in a drawer, the casino employee may easily pull the drawer outwardly and lift the fill bag directly up. Thus, when placed in the drawer, access to the fill bag is greatly improved, as is the safety of the employee.

Another advantage of the invention is that in one embodiment, a separate drawer is provided for each gaming machine. In this manner, hopper fill bags can be dedicated to a specific gaming machine and not be intermingled or mixed.

An additional advantage is realized when the hopper fill bags are stored in the drawers separate from the coin drop compartment. In particular, the accounting for coins put into the machine and taken out of the machine can more easily be reconciled.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A stand for at least one gaming device, said gaming device having a bottom through which one or more coins may be dispensed, said stand having a first end and an opposing second end, a first side located between said first and second end and a second side spaced from said first side and located between said first and second ends, said first and second ends extending generally parallel to one another and said first and second sides extending generally parallel to one another and generally perpendicular to said first and second ends, said stand including an interior space, said interior space defined by a perimeter comprising said first end, said second end, said first side and said second side, and a base and a top, said interior space divided into a plurality of compartments, at least one of said compartments comprising a first, a second, a third and a fourth drawer area and at least one of said compartments comprising a coin compartment, a drawer located in each drawer area, each drawer moveable between a first position in which said drawer is located in said drawer area and a second position in which at least a portion of said drawer is extended from said stand outwardly of said area, at least one coin drop opening located in said top through which coins released from said at least one gaming device may pass to said coin compartment said first and second drawer areas located at said first end of said stand and said third and fourth drawer area located at said second end of said stand, said coin compartment being located between said first and second drawer area and said third and fourth drawer area.

2. The stand in accordance with claim 1 wherein one of said first and second drawer areas faces said first side of said stand and the other of said first and second drawer areas faces said second side of said stand.

3. The stand in accordance with claim 1 wherein said first and second drawer areas have an end defined by a dividing wall.

4. The stand in accordance with claim 1 including means for routing coins from said coin opening to said coin compartment.

5. The stand in accordance with claim 1 including at least one door located at said first side of said stand, said door moveable between a first position in which said coin compartment is closed and a second position in which said coin compartment is open.

6. The stand in accordance with claim 1 wherein said coin compartment is located between said drawer areas.

7. The stand in accordance with claim 1 wherein said at least one compartment includes an electrical compartment.

8. The stand in accordance with claim 7 including at least one door for selectively closing a portion of said electrical compartment at said first side of said stand.

9. A stand for at least one gaming device, said gaming device having a bottom through which one or more coins may be dispensed, said stand having a first end and an opposing second end, a first side located between said first and second end and a second side spaced from said first side and located between said first and second ends, said first and second ends extending generally parallel to one another and said first and second sides extending generally parallel to one another and generally perpendicular to said first and second ends, said stand including an interior space, said interior space defined by a perimeter comprising said first end, said second end, said first side and said second side, and a base and a top, said interior space divided into at least two compartments, at least one of said compartments comprising a first, a second, a third and a fourth drawer area and at least one of said compartments comprising a coin compartment, a drawer located in each drawer area, each drawer moveable between a first position in which said drawer is located in said drawer area and a second position in which at least a portion of said drawer is extended from said stand outwardly of said area, at least one coin drop opening located in said top through which coins released from said at least one gaming device may pass to said coin compartment, a first wall extending between said first side and second side of said stand in said interior area, said first and second drawer areas located between said first wall and said first end, and a second wall extending between said first side and second side of said stand in said interior area, said third and fourth drawer areas located between said second wall and said second end, and wherein said coin compartment is located between said first wall and second wall in said interior area.

10. The stand in accordance with claim 9 wherein said first and second drawer areas are divided by a first dividing wall extending between said first end and said first wall.

11. The stand in accordance with claim 10 wherein said third and fourth drawer areas are divided by a second dividing wall extending between said second end and said second wall.

12. A stand for supporting four gaming machines configured to release coins from a lower portion thereof, comprising:

a support having a first end, a second end, a first side, a second side, a bottom and a top defining an interior area, said interior area including a first drawer area located at said first end and facing said first side, a second drawer area located at said first end and facing said second side, a third drawer area located at said second end and facing said first side, a fourth drawer area located at said second end and facing said second side, a coin compartment located between said first and second drawer area on one side and said third and fourth drawer area on the other side, said coin compartment accessible from at least one of said sides of said support;

a drawer associated with each of said first, second, third and fourth drawer areas, each drawer adapted to be moved to a position in which the drawer is located in the drawer area or a position where at least a portion of the drawer is extended from the drawer area;

at least one opening through said top corresponding to each of said four gaming machines, each opening permitting the passage of coins from the gaming machine to the coin compartment.

13. The stand in accordance with claim 12 wherein said first drawer area and second drawer area located between a wall comprising said first end and a first dividing wall spaced from said wall comprising said first end, and a common rear wall extending between said wall defining said first end and said dividing wall.

14. The stand in accordance with claim 12 including a first dividing wall extending between said sides and a second dividing wall extending between said sides, wherein said coin compartment is located between said first and second dividing walls.

15. The stand in accordance with claim 14 including an electrical area, said electrical area accessible from said second side of said support and said coin compartment accessible from said first side of said support, and wherein said electrical area and coin compartment are separated by a wall.

16. The stand in accordance with claim 12 including means located at each opening for directing coins to said coin compartment.

17. The stand in accordance with claim 16 wherein said means comprises a funnel.

18. The stand in accordance with claim 16 wherein said bottom is supported by one or more legs, said legs cooperating with said bottom to define a space us define a space below said bottom.

19. A stand for at least one gaming device, said gaming device having a bottom through which one or more coins may be dispensed, said stand having a first end and an opposing second end, a first side located between said first and second end and a second side spaced from said first side and located between said first and second ends, said first and second ends extending generally parallel to one another and said first and second sides extending generally parallel to one another and generally perpendicular to said first and second ends, said stand including an interior space, said interior space defined by a perimeter comprising said first end, said second end, said first side and said second side, and a base and a top, said interior space divided into at least one first drawer area located at said first end, at least one second drawer area located at said second end, and at least one coin compartment and at least one electrical compartment, said at least one coin compartment and said at least one electrical compartment positioned between said at least one first and second drawer area, a drawer located in each drawer area, each drawer moveable between a first position in which said drawer is located in said drawer area and a second position in which at least a portion of said drawer is extended from said stand outwardly of said area, and at least one coin drop opening located in said top through which coins released from said at least one gaming device may pass to said at least one coin compartment.

20. The stand in accordance with claim 19 including at least one electrical opening in said top leading to said at least one electrical compartment.

21. The stand in accordance with claim 19 wherein said stand is configured to support two gaming machines side by side and said stand includes a single first drawer and a single second drawer.

22. The stand in accordance with claim 19 wherein said at least one coin compartment is located adjacent said at least one first drawer and said at least one electrical compartment is located between said at least one second drawer and said at least one coin compartment.

23. The stand in accordance with claim 19 said stand is configured to support four gaming machines and first and second drawers are located at said first side and third and fourth drawers are located at said second side.

* * * * *